US006910978B2

(12) United States Patent
Cooper

(10) Patent No.: US 6,910,978 B2
(45) Date of Patent: Jun. 28, 2005

(54) GAME RACKET

(76) Inventor: John Scott Cooper, 6231 Yarrow Dr., Suite B, Carlsbad, CA (US) 92009-1540

( * ) Notice: Subject to any disclaimer, the term of this patent is extended or adjusted under 35 U.S.C. 154(b) by 560 days.

(21) Appl. No.: 10/045,737

(22) Filed: Jan. 14, 2002

(65) Prior Publication Data

US 2003/0134702 A1 Jul. 17, 2003

(51) Int. Cl.[7] ..... A63B 49/00; A63B 51/04
(52) U.S. Cl. ..... 473/528; 473/521; 473/529
(58) Field of Search ..... 473/527, 528, 473/529, 524, 521, 463; 40/603, 586, 618

(56) References Cited

U.S. PATENT DOCUMENTS 3,048,399 A * 8/1962 Breitbach ..... 473/457
3,734,499 A * 5/1973 Goldstein ..... 473/528
3,954,266 A * 5/1976 Carrano et al. ..... 273/348.2
5,160,147 A * 11/1992 Ping ..... 473/514
5,188,359 A * 2/1993 Wu ..... 473/528
5,217,222 A * 6/1993 Rudell et al. ..... 473/528
5,294,114 A * 3/1994 Stillinger ..... 473/528
5,294,115 A * 3/1994 Phillips et al. ..... 473/526
5,326,097 A * 7/1994 Yu ..... 473/528
6,402,646 B1 * 6/2002 Wolf ..... 473/543

* cited by examiner

*Primary Examiner*—Raleigh W. Chiu
(74) *Attorney, Agent, or Firm*—Adams & Wilks

(57) ABSTRACT

A game racket has a frame having a head portion and a handle portion extending from the head portion. A head cover covers inner and outer frame surfaces of the head portion. At least one elastic panel extends across the inner frame surface of the head portion and is connected to the head cover.

57 Claims, 5 Drawing Sheets

GAME RACKET

BACKGROUND OF THE INVENTION

FIELD OF THE INVENTION

The present invention relates generally to recreational game rackets and, more particularly, to a game racket for use in wet environments to play a racket game during training or informal play and/or as an advertising device.

BACKGROUND OF THE INVENTION

There are many sport activity games in which the players strike a ball with rackets, returning the ball to a fellow-player or opponent, such as tennis, paddle ball, squash, badminton and racquetball. The conventional rackets are provided with a hand holdable shaft having a longitudinal axis and a head or frame having a striking surface with a center disposed generally on the longitudinal axis.

In most racket games, the striking surface of conventional rackets is solid-faced or is formed of an open mesh weaving of plastic or resilient cord. Such conventional rackets require that the ball be struck near the center of the striking surface for a smooth impact. If the ball is struck near the perimeter of the striking surface, a jarring moment is transmitted along the handle into the wrist and elbow of the player. If the player is not strong enough to resist this moment, the racket may twist and return the ball off-line. Prolonged use may cause wrist or elbow inflammation, particularly in young children.

During training of small children in the games of tennis, badminton, paddle ball and ping pong, for example, fundamentals are oftentimes not properly learned due to the fear associated with a racket having a striking surface fabricated from a rigid material such as plastic or a hard rubber material. Actual injuries and the fear thereof have a profound impact on the ability of young children to relax and concentrate on racket games. In numerous instances, the potential risk of being hit by the racket leads many young children to shun racket games.

Moreover, conventional rackets are also inappropriate for use in wet environments, such as in a pool, at the beach or in the rain.

The present invention overcomes many of the disadvantages inherent in conventional game rackets.

SUMMARY OF THE INVENTION

It is an object of the present invention to provide a game racket for use in wet environments to play a racket game during training or informal play and/or as an advertising device.

It is another object of the present invention to provide a game racket having a resilient or flexible striking surface for striking a ball to enable a smooth impact between the game racket and the ball.

It is another object of the present invention to provide a durable game racket for play and training which is constructed so as to substantially reduce the risk of injury to players and physical damage to property.

It is another object of the present invention to provide a game racket that may be used as a training tool for racket sports at all levels, such as tennis, squash, badminton and racquetball, in order to facilitate learning of fundamentals at a quicker rate.

It is yet another object of the present invention to provide a game racket that may be used in wet environments without damaging the game racket or adversely affecting the flexibility of the striking surface and useability of the game racket.

It is another object of the present invention to provide a game racket which is lightweight, durable in strength, and rugged in construction.

It is another object of the present invention to provide a game racket which is easy and economical to manufacture.

It is still another object of the present invention to provide an advertising device comprising a game racket having a fabric covering which can be imprinted with selected indicia so that the device can be used as an advertising device.

The foregoing and other objects of the present invention are carried out by a game racket comprising a frame-having a head portion and a handle portion extending from the head portion. A head cover covers inner and outer frame surfaces of the head portion. At least one elastic panel extends across the inner frame surface of the head portion and is connected to the head cover. Preferably, the head cover comprises an elastic head cover sewn to and around a marginal edge portion of the elastic panel.

Preferably, the elastic panel has a main body formed from a single piece of elastic material comprising, for example, a synthetic rubber such as open- or closed-cell neoprene. The elastic panel has a fabric layer disposed on one or both opposed major surfaces of the main body and defining a ball-striking surface of the elastic panel.

In another embodiment, two elastic panels extend across the inner frame surface of the head portion and are connected to the head cover. The head cover comprises an elastic head cover formed in one piece with one of the elastic panels and sewn to and around a marginal edge portion of the other elastic panel.

A handle cover is preferably fitted on the handle portion of the frame. The handle cover is preferably comprised of two elastic panels sewn along side and lower marginal edge portions thereof to that upper marginal edge portions of the elastic panels form an opening which receives the handle portion of the frame. Each of the elastic panels has a main body formed from a single piece of material comprising, for example, a synthetic rubber such as open- or closed-cell neoprene. A fabric layer is disposed on one or both opposed main surfaces of each of the main bodies.

In another aspect, the present invention is directed to an advertising device comprising a frame having a head portion and a handle portion, an elastic outer casing covering the head portion and having a first outer surface, an elastic panel connected to the elastic outer casing along marginal edge portions thereof and having a second outer surface opposite the first outer surface, a pair of fabric layers each disposed on a respective one of the first and second outer surfaces to define ball-striking surfaces of the outer casing and the elastic panel, and advertising indicia disposed on the ball-striking surfaces of the outer casing and the elastic panel.

BRIEF DESCRIPTION OF THE DRAWINGS

The foregoing summary, as well as the following detailed description of preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangement and instrumentalities shown. In the drawings.

DETAILED DESCRIPTION OF THE PREFERRED EMBODIMENTS

Figure 1:
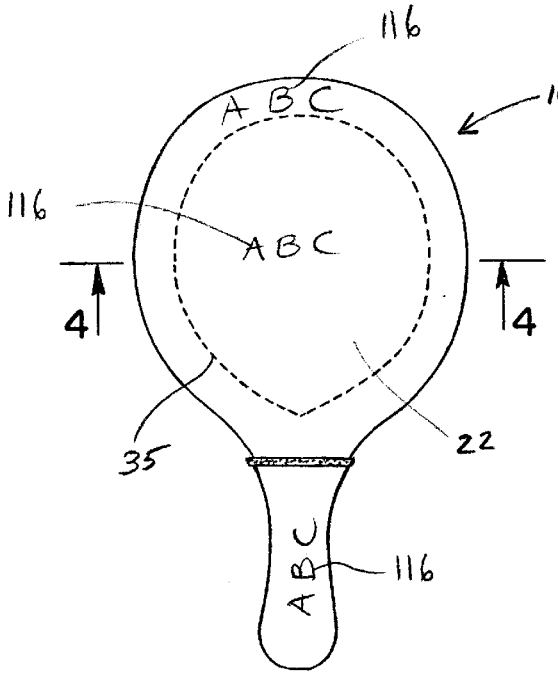
FIG. 1 is a front elevational view of a game racket according to a first embodiment of the present invention.

While this invention is susceptible of embodiments in many different forms, this specification and the accompanying drawings disclose only some forms as examples of the use of the invention. The invention is not intended to be limited to the embodiments so described, and the scope of the invention will be pointed out in the appended claims.

Referring now to the drawings in detail, wherein like numerals are used to indicate like elements throughout, there is shown in FIGS. 1–6 and 12A–12B a game racket, generally designated at 10, according to a first embodiment of the present invention. The game racket 10 is constructed with a frame 12 having a generally circular head portion 14 and a handle portion 16 extending from the head portion 14, an elastic outer casing 18 enclosing and covering the head portion 14, and an elastic panel 20 having a main body 21, preferably formed from a single piece of elastic material, connected to the elastic outer casing 18 along marginal edge portions thereof to form opposed ball-striking surfaces 22, 24 of the game racket 10. Each of the elastic outer casing 18 and the elastic panel 20 has a main body 19, 21, respectively, preferably formed from a single piece of elastic material. A grip member comprises first and second parts 26*a*, 26*b* having the same shape as the handle portion 16 and connected to opposed major surfaces of the handle portion 16. A handle cover 28 is fitted on the handle portion 16 and the grip member. The term "generally circular" as used herein to describe the shape of the head portion 14 of the frame 12 will be understood to include ovals of the type commonly used in game rackets.

The elastic outer casing 18 has a head cover portion 30 covering inner and outer frame surfaces 14*a*, 14*b* of the head portion 14 and a panel portion 32 extending across the inner frame surface 14*a* of the head portion 14. The handle portion 16 of the frame extends from an open lower section 18*b* of the elastic outer casing 18 where a slit 18*c* separates cover portions 18*d*, 18*e* to facilitate placement of the elastic outer casing 18 over the head portion 14 of the frame 12 during assembly of the game racket 10.

Figure 2:
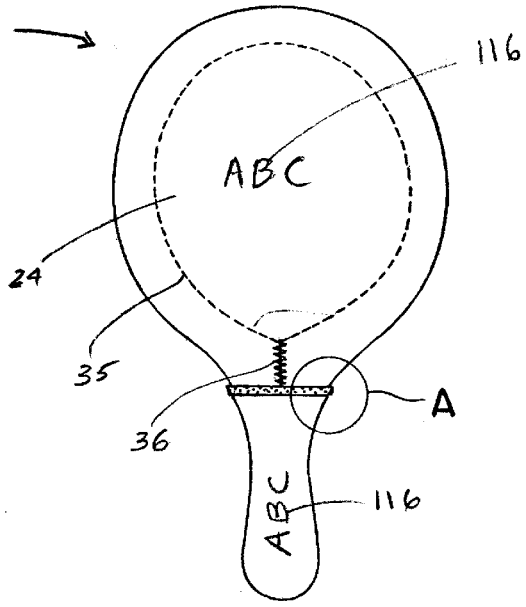
FIG. 2 is a rear elevational view of the game racket according to the first embodiment.
Figure 3:
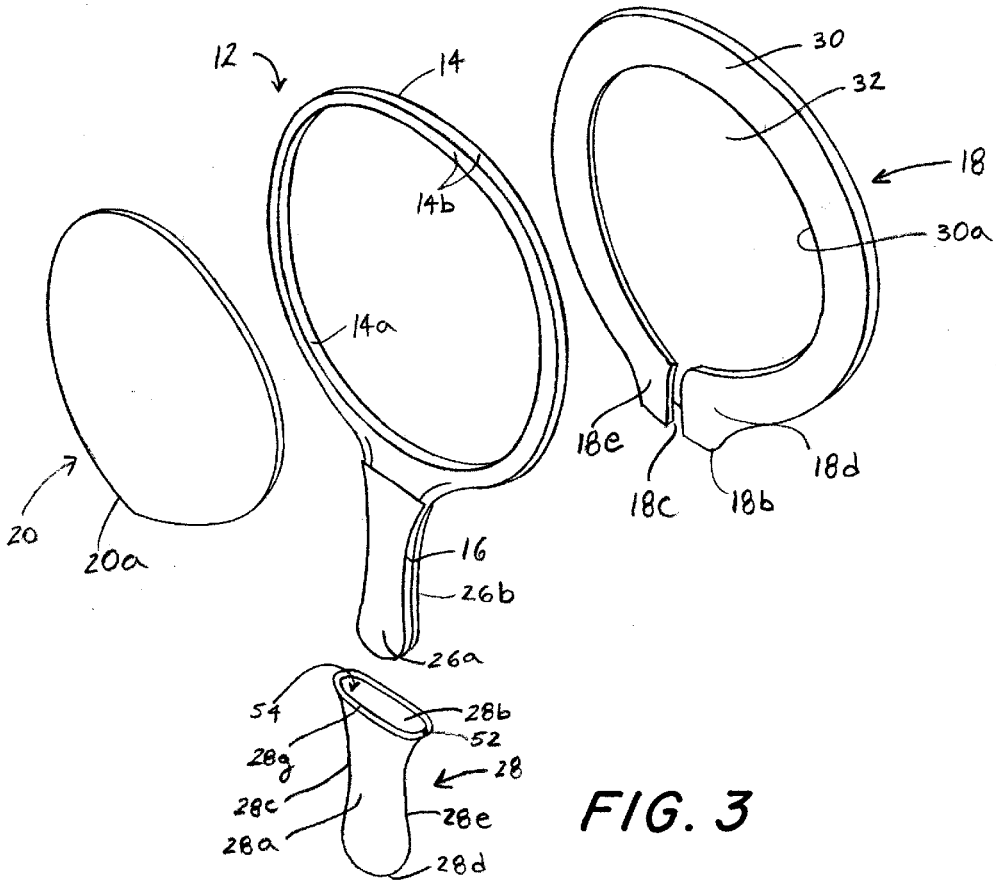
FIG. 3 is an exploded perspective view of the game racket according to the first embodiment.
Figure 4:
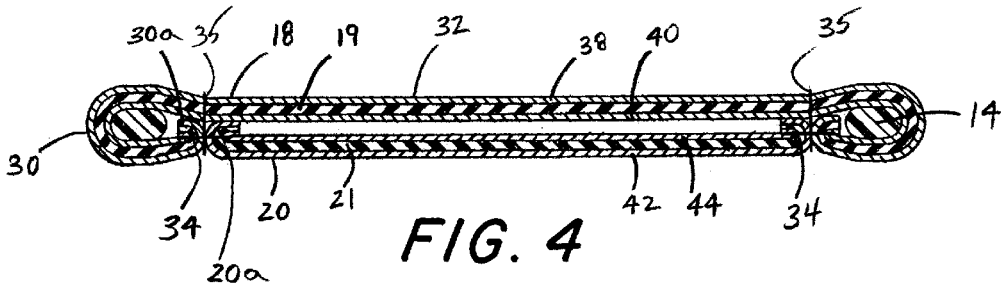
FIG. 4 is a cross-sectional view taken along line 4—4 in FIG. 1.

Referring to FIGS. 2–4, marginal edge portions 20*a*, 30*a* of the elastic panel 20 and the head cover portion 30, respectively, are superposed and sewn together along a first stitch line defined by stitches 34 which are denoted by horizontal lines in FIG. 4. After the sewing process, the marginal edge portions 20*a*, 30*a* are folded over the elastic panel 20 and the head cover portion 30, respectively. The marginal edge portions 20*a*, 30*a* of the elastic panel 20 and the head cover portion 30 are sewn to the panel portion 32 of the elastic outer casing 18 along a second stitch line defined by stitches 35 which are denoted by vertical lines in FIG. 4. The cover portions 18*d*, 18*e* of the elastic outer casing 18 are sewn along marginal edge portions thereof along a third stitch line defined by stitches 36. The sewing process can be easily accomplished using an industrial sewing machine.

Referring to FIG. 4, opposed main surfaces of the main body 19 of the elastic outer casing 18 and opposed main surfaces of the main body 21 of the elastic panel 20 are covered by fabric layers 38, 40 and 42, 44, respectively, which conform to the shapes of the elastic outer casing 18 and the elastic panel 20. The stitches 35 extend through the fabric layer 42, the main body 21, the fabric layer 44, the fabric layer 40, the main body 19 and the fabric layer 38. By this construction, the fabric layers 38 and 42 define the ball-striking surfaces 22, 24, respectively, of the game racket 10.

Referring to FIGS. 3, 5, 6 and 12A–12B, the handle portion 16 of the frame has a plurality of holes 46 extending through the opposed major surfaces thereof. The first part 26*a* of the grip member has hollow portions 48 disposed generally along a central longitudinal axis thereof. The second part 26*b* of the grip member has projecting portions 50 disposed generally along a central longitudinal axis thereof. In the assembled state, each projecting portion 50 of the second part 26*b* extends through respective ones of the holes 46 of the handle portion 16 and engages a respective one of the hollow portions 48 of the first part 26*a* of the grip member with a friction fit. By this construction, the grip member is fitted and held firmly on the handle portion 16 of the frame 12 to provide a solid grip during use of the game racket 10.

The handle cover 28 is fitted on the handle portion 16 of the frame and on the first and second parts 26*a*, 26*b* of the grip member. Preferably, the handle cover 16 comprises two elastic panels 28*a*, 28*b* each having a main body 29 preferably formed from a single piece of elastic material and each having the same shape as the handle portion 16 and the first and second parts 26*a*, 26*b* of the grip member. Side marginal edge portions 28*c*, 28*e* and lower marginal edge portion 28*f* of the pieces of elastic material 28*a*, 28*b* are sealed together by a sewing process along a stitch line defined by stitches 52 so that upper marginal edge portions 28*g* of the elastic panels 28*a*, 28*b* form an opening 54 which receives the handle portion 16 and the grip member.

Figure 5:
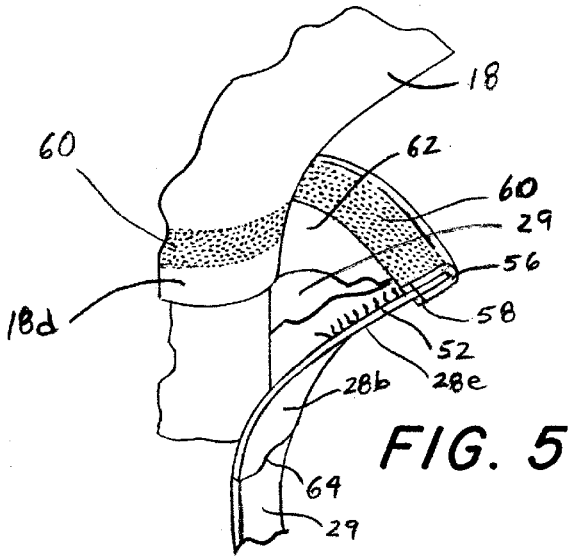
FIG. 5 is an enlarged fragmentary view of a portion of the game racket shown within a circle A in FIG. 2 showing portions of the elastic outer casing and the elastic handle cover prior to sealing.
Figure 6:
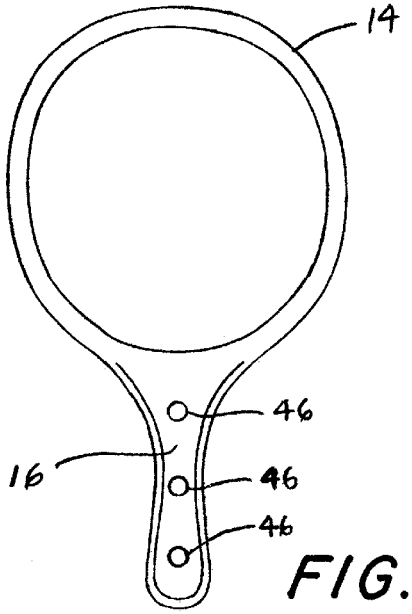
FIG. 6 is a front elevational view of the frame of the game racket according to the first embodiment.

Referring to FIG. 5, for each of the elastic panels 28*a*, 28*b* of the handle cover 28, a binding strip 56 is sewn around the upper marginal edge portion 28*g* along a stitch line defined by stitches 58. The marginal edge portion 28*g* and the binding strip 56 are adhered to the cover portions 18*d*, 18*e* using a suitable adhesive 60, for example thermoplastic synthetic resin adhesives or thermosetting synthetic resin adhesives. Opposed main surfaces of the main body 29 of each of the elastic panels 28*a*, 28*b* are covered by an inner fabric layer 62 and an outer fabric layer 64, respectively, which conform to the shapes of the elastic panels 28*a*, 28*b*. Each of the binding strips 56 is disposed around a respective one of the marginal edge portions 28*g* and overlap the fabric layers 62, 64 in direct contact therewith. The stitches 58 extend through the binding strips 56, the main body 29 and the fabric layers 62, 64. By this construction, the outer fabric layers 64 of the elastic panels 28*a*, 28*b* define gripping surfaces of the game racket.

In one example of the present embodiment, each of the main bodies 19, 21 and 29 of the elastic outer casing 18, the elastic panel 20 and the elastic panels 28*a*, 28*b* of the handle cover 28, respectively, preferably comprises a single piece of porous synthetic rubber cellular material, such as open-cell neoprene.

In another example of the present embodiment, each of the main bodies 19, 21 and 29 of the elastic outer casing 18, the elastic panel 20 and the elastic panels 28*a*, 28*b* of the handle cover 28, respectively, preferably comprises a single piece of non-porous synthetic rubber cellular material which is impervious to water, such as closed-cell neoprene. Closed-cell neoprene exhibits excellent waterproof properties due to its non-absorbent characteristic, thereby allowing effective use of the game racket 10 in various wet environments such as in a pool, the beach or in the rain.

Both open- and closed-cell neoprene have a desirable flexible property which permits it to be repeatedly elastically deformed without damage or permanent deformation while providing the necessary structural integrity for shape retention. Thus, the ball-striking surfaces of the game racket can repeatedly strike a ball without damage or permanent deformation to the elastic panels 20 and 32. The flexible nature of neoprene also functions to absorb shock upon impact and thus provides an inherent safety factor.

Neoprene is also highly resistant to weather and sunlight due to its extremely low rate of oxidation. Thus the use of open or closed-cell neoprene for the main bodies 19, 21 and 29 of the elastic outer casing 18, the elastic panel 20 and the elastic panels 28*a*, 28*b* of the handle cover 28, respectively, allows effective use of the game racket 10 in various outdoor and indoor environments without affecting its flexibility and useability, including long exposures to sunlight.

The fabric layers 38,40 42,44 and 62,64 are preferably formed from thin layers of nylon which are preferably bonded to the opposed major surfaces of the main bodies 19, 21 and 29, respectively. During use of the game racket 10 in wet environments, the thin nylon layers protect the main bodies 19, 20 and 29 and retain some moisture to give the game racket sufficient weight to provide the game racket with realistic dynamic characteristics, such as stability and improved handling. Additionally, the properties of nylon enable the retained moisture to be sprayed when the ball-striking surfaces 22, 24. This feature provides an aesthetic display while playing a racket sport on beaches or around swimming pools, where the ability to attract attention of spectators and by-passers is at least as valued as any perceived aerobic or recreational value of the sport. Nylon is also a tough, lightweight material which is difficult to tear and can be easily cleaned. Thus the properties of nylon allow the game racket to be used in wet environments without damaging the game racket or adversely affecting its flexibility and/or useability. The use of nylon for the fabric layers 62, 64 of the elastic panels 28*a*, 28*b* also provides for an enhanced gripping surface to aid in handling the game racket 10 during a racket game. Other suitable materials for the fabric layers 38,40 42,44 and 62,64 which exhibit the above properties include, but are not limited to, lycra, polyester, fleece and polypropylene.

The binding strips 56 are preferably formed from nylon webbing material which is a tough, lightweight material which is difficult to tear and can be easily cleaned. The nylon binding strips 56 will also retain some moisture during use of the game racket 10 in wet environments to give the game racket some weight to further enhance the stability, performance and handling of the game racket. Other suitable materials for the binding strips 56 include, but are not limited to, lycra, polyester, fleece and polypropylene.

Figure 7:
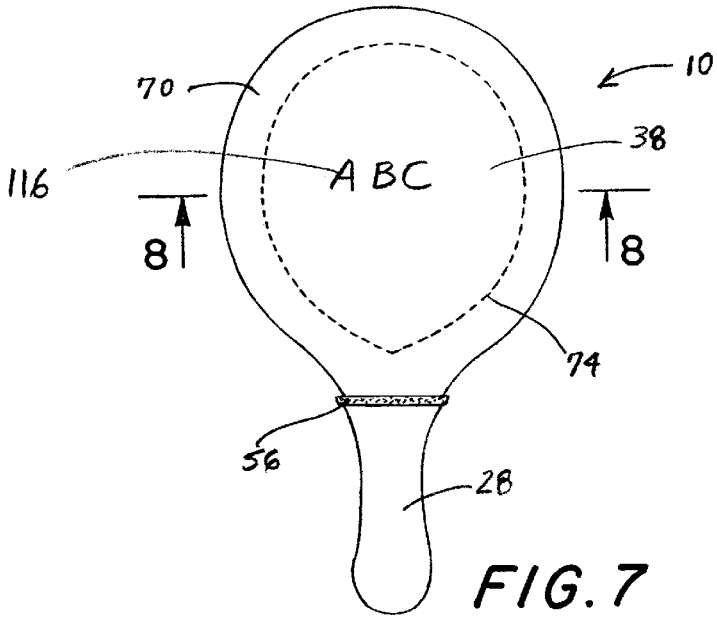
FIG. 7 is a front elevational view of a game racket according to a second embodiment of the present invention.
Figure 8:
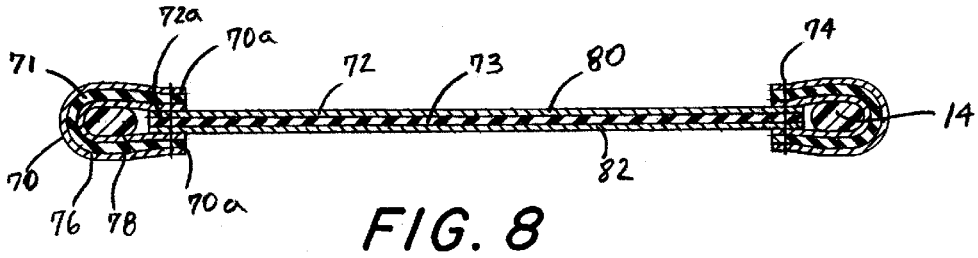
FIG. 8 is a cross-sectional view taken along line 8—8 in FIG. 7.

FIGS. 7–8 show a game racket according to a second embodiment of the present invention. In the second embodiment, the construction of the frame 12 is the same as described above for the first embodiment. However, in the second embodiment a head cover 70 having a main body 71 covers the inner and outer frame surfaces 14*a*, 14*b* of the head portion 14. A single elastic panel 72 having a main body 73 extends across the inner frame surface 14*a* of the head portion 14. The head cover 70 and the elastic panel 72 are sewn around marginal edge portions 70*a*, 72*a* thereof, respectively, along a stitch line defining stitches 74 using, for example, an industrial sewing machine. Opposed main surfaces of the main body 71 of the head cover 70 and opposed main surfaces of the main body 73 of the elastic panel 72 are covered by fabric layers 76, 78 and 80, 82, respectively, which conform to the shapes of the head cover 70 and the elastic panel 72. The stitches 74 extend through the fabric layer 76, the main body 71, the fabric layer 78, the fabric layer 82, the main body 73 and the fabric layer 80. By this construction, the fabric layers 80, 82 define the ball-striking surfaces of the game racket 10.

In the second embodiment, the construction of the handle portion 16, the grip member 26*a*, 26*b* and the handle cover 28 is the same as described above for the first embodiment. Each of the main bodies 71, 73 of the head cover 70 and the elastic panel 72, respectively, may comprise, for example, a single piece of synthetic rubber cellular material, such as open or closed-cell neoprene, as described above for the first embodiment. Likewise, the fabric layers 76, 78 and 80, 82 are preferably formed from thin layers of nylon which are preferably bonded to the opposed major surfaces of the main bodies 71, 73, respectively. Other suitable materials for the fabric layers 76, 78, 80 and 82 which exhibit the properties described above for the first embodiment include, but are not limited to, lycra, polyester, fleece and polypropylene.

Figure 9:
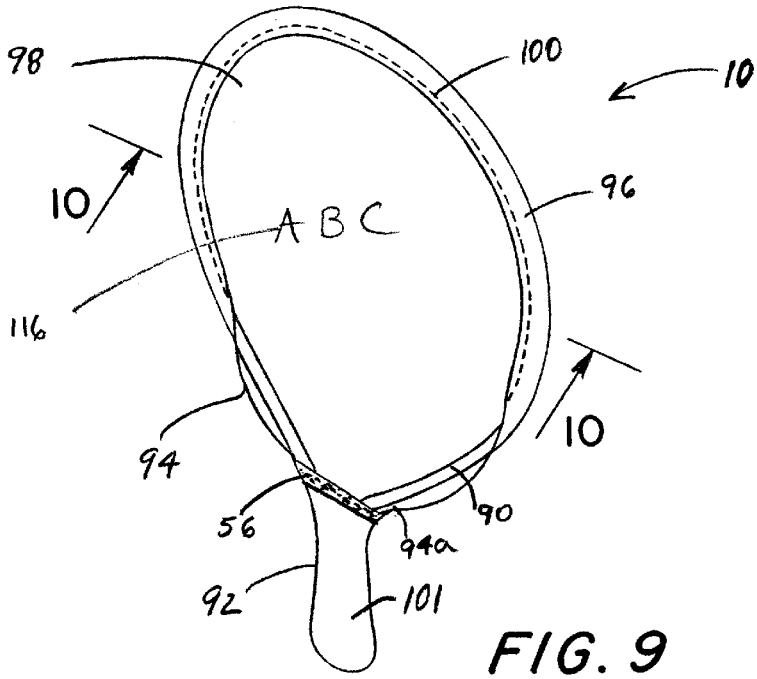
FIG. 9 is a perspective view of a game racket according to a third embodiment of the present invention with the head cover portion of the elastic outer casing partially removed to show the head portion of the frame.
Figure 10:
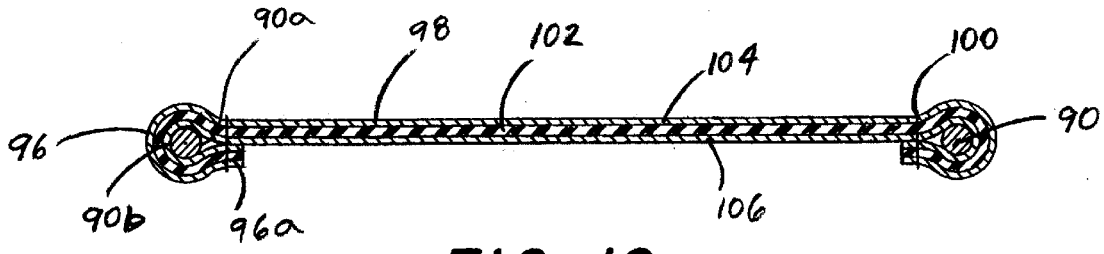
FIG. 10 is a cross-sectional view taken along line 10—10 in FIG. 7.

FIGS. 9–10 show a third embodiment of a game racket 10 according to the present invention. The game racket 10 is constructed with a frame having a generally circular head portion 90 and a handle portion 92 extending from the head portion 90. An elastic outer casing 94 has a head cover portion 96 covering inner and outer frame surfaces 90*a*, 90*b* of the head portion 90 and an elastic panel portion 98 extending across the inner frame surface 90*a*. A marginal edge portion 96*a* of the head cover portion 96 is sewn to the elastic panel portion 98 along a stitch line defining stitches 100. A grip member (not shown) is fitted and held firmly on the handle portion 92 of the frame. A handle cover 101 is fitted on the handle portion 92 of the frame and on the grip member.

The elastic outer casing 94 has a main body 102 preferably formed from a single piece of elastic material. Opposed main surfaces of the main body 102 are covered by fabric layers 104, 106 which conform to the shape of the elastic outer casing 94. The stitches 100 extend through the main body 102 and the fabric layers 104, 106. By this construction, the fabric layers 104, 106 define opposite ball-striking surfaces of the game racket 10.

In the third embodiment, the structural construction of the handle portion 92 and the grip member is the same as described above for the first embodiment. The handle cover 101 has the same construction as the handle cover 28 described above for the first embodiment and is connected to a lower end portion 94*a* of the elastic outer casing 94 preferably by adhering using a suitable adhesive such as, for example, thermoplastic synthetic resin adhesives or thermosetting synthetic resin adhesives. The main body 102 of the elastic outer casing may comprise, for example, a single piece of synthetic rubber cellular material, such as open or closed-cell neoprene, as described above for the first embodiment. Likewise, the fabric layers 104, 106 are preferably formed from thin layers of nylon, or other suitable material, which are preferably bonded to the opposed major surfaces of the main body 101.

Figure 11:
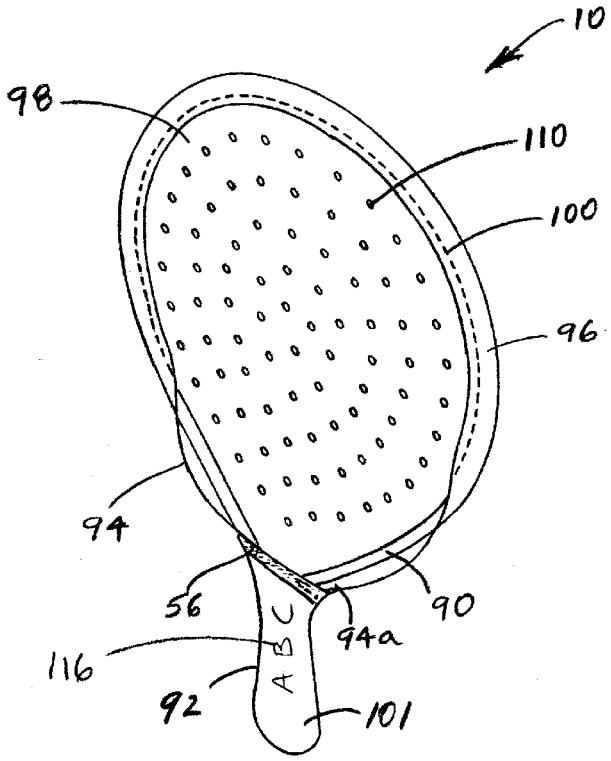
FIG. 11 is a perspective view of another example of the game racket according to the third embodiment.
Figure 12A:
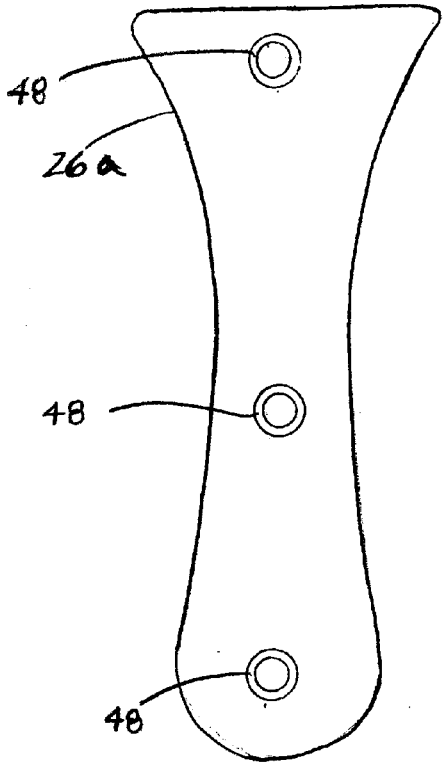
FIGS. 12A–12B are elevational views of the first and second parts of the grip member fitted on the handle portion of the game racket according to the present invention.
Figure 12B:
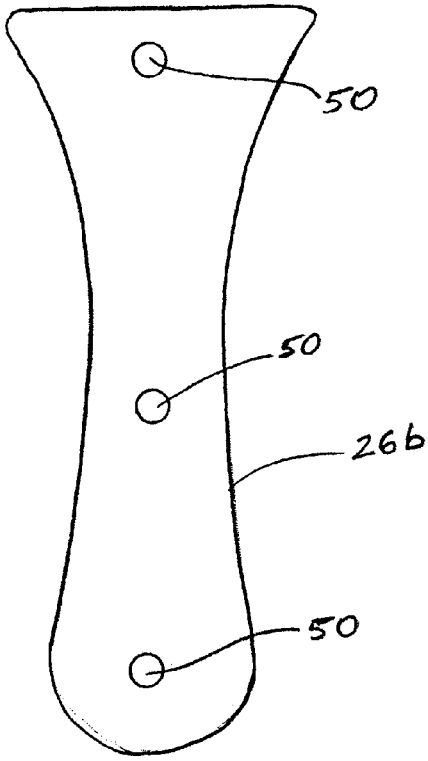

FIG. 11 shows a modified version of the game racket 10 according to the third embodiment of the present invention. The modified game racket 10 has generally the same construction as that described above for the third embodiment. However, the modified game racket 10, holes 110 extend through the elastic panel portion 98 of the elastic outer casing 94. More specifically, the holes 110 extend through portions of the fabric layers 104, 106 and the main body 102 which make up the elastic panel portion 98. Thus in the modified embodiment of FIG. 11, the ball-striking surfaces of the game racket 10 are defined by the fabric layers 104, 106 which are provided with through-holes 110.

During construction of the game racket according to the foregoing embodiments, the material for the main bodies of the elastic outer casing, the head cover and the handle cover are cut from a suitable synthetic rubber material or the like either manually or with an industrial cutting machine using appropriate patterns. The fabric layers are cut in a similar manner from nylon, lycra, polyester, polypropylene or the like and then bonded to the opposed major surfaces of the main bodies by, for example, a conventional heat bonding process. Alternatively, the fabric layers are bonded to the opposed major surfaces of the main bodies prior to the foregoing cutting step, and then the main bodies with the fabric layers bonded thereon are cut simultaneously using the patterns. The binding strips are also cut by hand or with an industrial cutting machine into linear strips from nylon, lycra, polyester, fleece, polypropylene or other suitable material.

In the embodiments of the game racket 10 disclosed in the foregoing embodiments, the fabric layers are preferably bonded to the opposed major surfaces of the main bodies prior to the sewing process. However, it will be appreciated by those of ordinary skill in the art that other methods of securing the fabric layers to the surfaces of the main bodies are suitable. For example, the fabric layers conforming to the shape of the main bodies can be placed adjacent the opposed major surfaces of the main bodies and then the fabric layers can be sewn to the main bodies along marginal edge portions thereof in a single sewing process. It will also be appreciated by those of ordinary skill in the art that the construction of the game racket 10 can be modified by bonding or sewing a fabric layer on only one of the opposed major surfaces of the main bodies, or by fabricating the game racket without the fabric layers.

Although described above with a specific application to racket sports, the game racket 10 according to any of the foregoing embodiments of the present invention is also applicable as an advertising device. For example, as shown in FIGS. 1, 2, 7, 9 and 11, one or more of the fabric layers can be imprinted or embroidered with decorative designs, graphics or advertising indicia 116, such as a company name or logo, an advertising message, by using, for example, a printing or an embroidering process prior or subsequent to bonding the fabric layers to the main body or the sewing process as set forth above. Alternatively, both of the fabric layers 38, 42 can be imprinted with the decorative designs or the advertising message 116. Furthermore, instead of imprinting or embroiding indicia, one or more decals containing indicia may be attached to one or both of the fabric layers 38 40. The visual representations add desired decorative and aesthetic effects to the game racket for attracting attention, which is particularly advantageous when the game racket is used as an advertising or promotional item.

The frame and the grip member of the game racket can be formed of any suitable durable and strong material which is able to withstand repetitive impact and swinging movements during use of the game racket. If formed of plastics, various plastics such as polystyrene, polypropylene and high density polyethylene can be used and these plastics can, if desired, be reinforced with a suitable fibrous reinforcing material such as fiberglass, carbon and graphite fibers. When formed of plastics, the frame and grip member are preferably injection-molded for low cost and ease of manufacturing. Other suitable materials for the frame and the grip member include, but are not limited to, wood, steel, stainless steel, aluminum and magnesium.

In the preferred embodiments of the game racket according to the present invention, the material for the main body of each of the elastic outer casing, elastic head cover and elastic panels comprises a synthetic rubber material, such as open- or closed cell neoprene. However, other materials are also suitable for the main bodies. For example, sponge materials or any resilient, deformable, cellular elastomeric material such as natural or synthetic sponge or foam rubber are also suitable for the material of the main bodies.

The construction of the game racket according to the present invention offers the advantage that it enables an excellent hand hold to be obtained and the game racket is prevented from twisting in the hand, even if strikes are intense and repeated. More specifically, when a ball is struck with the ball-striking surfaces of the game racket, the elastic panels stretch and provide a cushioning effect to the impact reaction transmitted back through the player's hand. The elastic panels then quickly rebound to return energy to propel the ball. The elastic material of the panels further reduces the torque moment of an off-center strike. Thus the elastic panels provide resilient or flexible ball-striking surfaces which further alleviate the transmission of a jarring moment along the handle portion of the game racket into the wrist and elbow of the player, thereby greatly reducing the risk of wrist or elbow inflammation, particularly in young children. Furthermore, the fabric layers of the handle portion prevent the hand from recoiling and sliding from the handle.

Moreover, the flexing and rebounding elastic panels create sound waves which are perceived by human ears as a loud noise associated with a powerful impact, thus exaggerating the apparent prowess of the players.

The inventive game racket is highly durable and resistant to structural or performance degradation. It will be appreciated that the ball-striking surfaces of the game rackets can not only be different in terms of their strength, weight and performance but also different sizes. Furthermore, the ball-striking surfaces are normally circular or generally circular but it is intended that "generally circular" includes other shapes particularly oval and elliptical shapes, known per se, in normal sports rackets.

It will be appreciated by those skilled in the art that the game racket according to the present invention may be used to play racket sports during informal play near crowds or indoors without the risk of injury to players, physical damage to property or other inherent risks associated with rigid game rackets. The game racket of the present invention is also well suited as a training tool for learning the fundamentals of racket games adequately and at a quicker rate. Thus the unique construction and the combination of materials from which the game racket of the present invention is comprised results in a highly versatile game racket that extends the opportunities of training of players of any degree of experience, age or strength.

By constructing the game racket according to the present invention using elastic main bodies formed from a single piece of non-porous, water-impervious material, such as closed-cell neoprene, the game racket is particularly well adapted for use in wet environments without damaging the game racket or adversely affecting the flexibility and useability of the game racket. Furthermore, the game racket according to the present invention is light in weight, is rugged and durable in construction, and may be manufactured easily and at a low cost.

Moreover, when the game racket according to the present invention is fabricated with a fabric layer on one or both of the opposed ball-striking surfaces, a suitable medium is provided for receiving selected indicia so that the game racket can be used as an advertising or promotional device.

From the foregoing description, it can be seen that the present invention comprises an improved game racket. It will be appreciated by those skilled in the art that obvious changes can be made to the embodiments described in the foregoing description without departing from the broad inventive concept thereof. It is understood, therefore, that this invention is not limited to the particular embodiments disclosed, but is intended to cover all obvious modifications thereof which are within the scope and the spirit of the invention as defined by the appended claims.

What is claimed is:

1. A game racket comprising:

a frame having a head portion and a handle portion extending from the head portion, the head portion having inner and outer frame surfaces;

a head cover covering the inner and outer frame surfaces of the head portion; and at least one elastic panel extending across the inner frame surface of the head portion and connected to the head cover.

2. A game racket according to claim 1; wherein the head cover comprises an elastic head cover sewn to and around a marginal edge portion of the elastic panel.

3. A game racket according to claim 1; wherein the elastic panel has opposite main surfaces each defining a ball-striking surface.

4. A game racket according to claim 1; wherein the at least one elastic panel comprises two elastic panels extending across the inner frame surface of the head portion and connected to the head cover, each of the elastic panels having a ball-striking surface.

5. A game racket according to claim 4; wherein the head cover comprises an elastic head cover formed in one piece with one of the elastic panels and sewn to and around a marginal edge portion the other elastic panel.

6. A game racket according to claim 1; wherein the elastic panel has a main body formed from a single piece of elastic material.

7. A game racket according to claim 6; wherein the single piece of elastic material comprises synthetic rubber.

8. A game racket according to claim 7; wherein the synthetic rubber comprises open-cell neoprene.

9. A game racket according to claim 7; wherein the synthetic rubber comprises closed-cell neoprene.

10. A game racket according to claim 6; wherein the elastic panel has a fabric layer disposed on one or both opposed major surfaces of the main body.

11. A game racket according to claim 10; wherein the fabric layer defines a ball-striking surface of the elastic panel.

12. A game racket according to claim 1; wherein the head cover has a main body formed from a single piece of elastic material.

13. A game racket according to claim 12; wherein the single piece of elastic material comprises synthetic rubber.

14. A game racket according to claim 13; wherein the synthetic rubber comprises open-cell neoprene.

15. A game racket according to claim 13; wherein the synthetic rubber comprises closed-cell neoprene.

16. A game racket according to claim 12; wherein the head cover has a fabric layer disposed on one or both opposed major surfaces of the main body.

17. A game racket according to claim 16; wherein the fabric layer comprises nylon.

18. A game racket according to claim 1; further comprising a handle cover fitted on the handle portion of the frame.

19. A game racket according to claim 18; wherein the handle cover has a main body formed from a single piece of material.

20. A game racket according to claim 19; wherein the single piece of material comprises synthetic rubber.

21. A game racket according to claim 20; wherein the synthetic rubber comprises open-cell neoprene.

22. A game racket according to claim 20; wherein the synthetic rubber comprises closed-cell neoprene.

23. A game racket according to claim 1; wherein the frame is made of plastic.

24. A game racket according to claim 1; wherein the frame is made of metal.

25. A game racket according to claim 1; wherein the frame is made of wood.

26. A game racket according to claim 1; wherein the elastic panel has opposite main surfaces each defining a ball-striking surface, and a plurality of holes extending through the ball-striking surfaces.

27. A game racket according to claim 1; wherein the elastic panel has a main body formed from a single piece of elastic material, a fabric layer disposed opposed major surfaces of the main body and defining opposed ball-striking surfaces of the elastic panel, and a plurality of holes extending through the ball-striking surfaces.

28. A game racket according to claim 1; wherein the frame is made from a single piece of material which includes the head portion and the handle portion.

29. A game racket according to claim 28; further comprising a grip member comprised of first and second parts each connected to a respective one of opposed main surfaces of the handle portion.

30. A game racket according to claim 29; further comprising a handle cover fitted on the handle portion and the grip member.

31. A game racket according to claim 29; wherein the handle portion has at least one hole extending through the opposed main surfaces; and wherein the first part of the grip member has a hollow portion and the second part of the grip member has a projecting portion extending through the hole in the handle portion and engaging the hollow portion of the first part.

32. A game racket according to claim 31; further comprising a handle cover fitted on the handle portion and the grip member.

33. A game racket comprising:

a frame having a head portion and a handle portion extending from the head portion;

an elastic outer casing covering the head portion; and an elastic panel connected to the elastic outer casing along marginal edge portions thereof to form opposed ball-striking surfaces of the game racket.

34. A game racket according to claim 33; wherein the marginal edge portions of the elastic outer casing and the elastic panel are sewn along at least one stitch line.

35. A game racket according to claim 33; wherein each of the elastic casing and the elastic panel has a main body formed from a single piece of elastic material.

36. A game racket according to claim 35; wherein the single piece of elastic material comprises synthetic rubber.

37. A game racket according to claim 36; wherein the synthetic rubber comprises open-cell neoprene.

38. A game racket according to claim 36; wherein the synthetic rubber comprises closed-cell neoprene.

39. A game racket according to claim 35; wherein each of the elastic casing and the elastic panel has a fabric layer disposed on one or both opposed major surfaces of the main body.

40. A game racket according to claim 39; wherein the fabric layers define the ball-striking surfaces.

41. A game racket according to claim 40; further comprising an elastic handle cover fitted on the handle portion of the frame.

42. A game racket according to claim 41; wherein the elastic handle cover has a main body formed from a single piece of elastic material.

43. A game racket according to claim 42; wherein the single piece of elastic material comprises synthetic rubber.

44. A game racket according to claim 43; wherein the synthetic rubber comprises open-cell neoprene.

45. A game racket according to claim 43; wherein the synthetic rubber comprises closed-cell neoprene.

46. A game racket according to claim 42; wherein the elastic handle cover has a fabric layer disposed on one or both opposed major surfaces of the main body.

47. An advertising device comprising:

a frame having a head portion and a handle portion;

an elastic outer casing covering the head portion and having a first outer surface;

an elastic panel connected to the elastic outer casing along marginal edge portions thereof and having a second outer surface opposite the first outer surface;

a fabric layer disposed on one or both of the first outer surface and the second outer surface of the outer casing and the elastic panel, respectively; and advertising indicia disposed on the fabric layer.

48. An advertising device according to claim 47;

wherein each of the elastic casing and the elastic panel has a main body formed from a single piece of elastic material, each of the main bodies having a respective one of the first and second outer surfaces.

49. An advertising device according to claim 48;

wherein the single piece of elastic material comprises synthetic rubber.

50. An advertising device according to claim 49;

wherein the synthetic rubber comprises open-cell neoprene.

51. An advertising device according to claim 49;

wherein the synthetic rubber comprises closed-cell neoprene.

52. An advertising device according to claim 47; further comprising an elastic handle cover fitted on the handle portion of the frame.

53. An advertising device according to claim 52;

wherein the elastic handle cover has a main body formed from a single piece of elastic material.

54. An advertising device according to claim 53;

wherein the single piece of elastic material comprises synthetic rubber.

55. An advertising device according to claim 54;

wherein the synthetic rubber comprises open-cell neoprene.

56. An advertising device according to claim 54;

wherein the synthetic rubber comprises closed-cell neoprene.

57. An advertising device according to claim 53;

wherein the elastic handle cover has a fabric layer disposed on one or both opposed major surfaces of the main body.

* * * * *